United States Patent [19]

Whiting

[11] 4,084,638

[45] Apr. 18, 1978

[54] METHOD OF PRODUCTION STIMULATION AND ENHANCED RECOVERY OF OIL

[75] Inventor: Cuthbert R. Whiting, Saddle River, N.J.

[73] Assignee: Probe, Incorporated, Saddle River, N.J.

[21] Appl. No.: 623,098

[22] Filed: Oct. 16, 1975

[51] Int. Cl.[2] ..... E21B 43/24

[52] U.S. Cl. ..... 166/248; 166/249; 166/271; 166/302

[58] Field of Search ..... 166/248, 249, 271, 302

[56] References Cited

U.S. PATENT DOCUMENTS

| | | | |
|---|---|---|---|
| 2,795,279 | 6/1957 | Sarapuu | 166/248 |
| 2,799,641 | 7/1957 | Bell | 166/248 |
| 3,169,577 | 2/1965 | Sarapuu | 166/248 |
| 3,208,674 | 9/1964 | Bailey | 166/248 X |
| 3,620,300 | 11/1971 | Crowson | 166/248 |
| 3,642,066 | 2/1972 | Gill | 166/248 |

*Primary Examiner*—Stephen J. Novosad
*Assistant Examiner*—George A. Suchfield

[57] ABSTRACT

The present invention relates to an improved method of recovery of petroleum from presently existing wells which are either non-producing or low production types. The method utilizes surges and oscillations of electrical energy in excess of 150 kilovolts involving the use of heavy current flow over a carbonaceous path in order to establish heat, electrical and physical shock, and steam fracturing (or shattering) within certain sedimentary rock formations, thereby giving rise to an increase in the effective well and reservoir radius both within an existing well and between wells. The method involves the use of a minimum of two existing wells, one being an injection well and the other being a production or recovery well. In each well, insulated high voltage cable is secured within the well casing in order to feed required electrical energy into a probe rod which, at the bottom of each well is driven into the oil stratum in a configuration in which each probe is directed toward the other. The distance of the respective probes from each other will, depending upon factors of voltage, current flow and geological conditions, be disposed as close as 25 feet apart or, in any given instance, as far as 3,000 feet apart.

28 Claims, 9 Drawing Figures

METHOD OF PRODUCTION STIMULATION AND ENHANCED RECOVERY OF OIL

BACKGROUND OF THE INVENTION

Among the problems which have existed in the area of oil recovery, has been that of extracting, from a particular oil well, or well within a particular field, a satisfactory percentage of the total amount of the oil and gas within the particular petroleum reservoir.

This problem arises from the fact that, among the presently existing state of the art petroleum methods, none of said methods, which have proven to be otherwise practical, have produced an effective yield capability of more than 50 percent of the oil originally in place. The percentage of recovery which is generally obtainable will depend on such factors as: (1) the physical nature of both the reservoir rock and the oil itself; (2) the care exercised in completing and producing a particular well; and (3) the rate of oil and gas production from the field or reservoir as a whole.

Accordingly, it may be readily appreciated that vast quantities of valuable oil reserves have proven to be inaccessible by reason of various geological and technical factors. Alternatively, even where existent technology has proven adequate, the cost of such technology has proven to be unacceptable.

The prior art has of course witnessed various approaches which have been attempted in order to increase the recovery efficiency of existing oil wells.

For example, U.S. Pat. No. 3,103,975 (1963) entitled Communication Between Wells, held by A. W. Hanson, discloses a general technique directed to the utilization of an electrolyte in order to provide subterranean formations with an electro-chemical treatment which will improve the electrical communication within the various interstices which exist within a normal oil-bearing sedimentary stratum. Through the increase of such electrical communication, generally known as electrical conductivity, a flow of energy can be generated which will have the desired effect of enlarging the area of fracture and, thereby, the effective well or reservoir radius of the recovery area. Said patent to Hanson represents an interesting theoretical approach whose promise has not, as yet, been fully realized.

Also, of pertinence in the prior art in U.S. Pat. No. 3,106,244 (1963), entitled Process for Producing Oil Shale in Situ by Electro-carbonization, held by E. W. Parker. Said patent is representative of on-going technical efforts which have been exerted in the area of extracting oil from shale deposits through the appropriate application of electrical energy. As such, said patent represents another step in the development of the technology which has led to the present invention effort.

The use of electrical energy as a thermal source within petroleum strata is discussed in U.S. Pat. No. 3,149,672 (1964), entitled Method and Apparatus for Electrical Heating of Oil-Bearing Formations, held by J. Orkiszewski et al. An allied disclosure appears in U.S. Pat. No. 3,862,662, entitled Method and Apparatus for Electrical Heating of Hydro-Carbonaceous Formations, held by L. R. Kern.

Finally, and of close pertinence to the present inventive method, are U.S. Pat. Nos. 3,169,577 (1965) and 3,236,304 (1966), both held by E. Sarapuu. The first of said patents relates to the electro-linking of two wells through the use of impulse voltages on the order of 150 kilovolts. The second of said patents relates to a method for the electrofracing of oil sand formations through perforated casings.

The present inventive method may be viewed as a natural and necessary advancement of the above original but rudimentary methods proposed by the above inventors.

SUMMARY OF THE INVENTION

The present invention can be viewed as an effort to exploit what is believed to be the general susceptibility of reservoir rock to electrical energy when modulated and configurated in such a manner so as to utilize the particular physical and chemical characteristics of oil-bearing rock such as illustrated in FIG. 2.

While a wide variety of effects of electrical energy upon reservoir strata are believed to occur, most of such effects appear to be definable in terms of (1) heating effects and (2) shock effects.

The present invention seeks to utilize said heating effects in order to increase the fluidity of, and pressure upon, the oil existent in sedimentary strata in proximity to the electrical probes utilized in the present inventive method. That is, through an increase in the fluidity of and pressure upon oil trapped within cavities of limestone, sandstone, shale or other such oil-bearing formations, the probability of, through any one of a variety of electrical and physical mechanisms, release of said trapped oil will clearly increase, thereby enhancing the recovery efficiency of a given well or well system.

With regard to the anticipated electrical and physical shock effects of the present method, it is believed that oil reservoirs and, in particular, sandstone, shale and limestone reservoirs will prove to be highly susceptible to shock waves and, therefore, will create a degree of electrofracing and physical fracturing which will increase the amount of otherwise trapped oil that will be obtainable through the openings up of new paths to adjacent reservoirs.

In general, said above-described heating and shock effects will serve to greatly increase the geo-capillary flow of petroleum reserves within a given well system, and between wells.

In terms of formal objectives, the present invention may be viewed as having an object of providing a means for electrically linking one oil well to a second oil well, through an oil-bearing geological formation, in such a manner as to create a series of electrical, thermal and physical shocks adjacent to and between electrodes utilized at the bottom of said wells, thereby transmitting sufficient energy in order to cause fracturing in the vicinity of the well, and between wells, by means of electrical and physical impulses associated with discharged electrical energy.

It is a further object of the present invention to provide an electrical linking method between electrodes within an oil-bearing stratum by providing methods and means, at low initial cost, of light-weight equipment, powered by a portable electric generator or power line source having controllable output voltage, selectable frequency of pulsing and pulse width, and sufficiently high peak power output in order to obtain desired electrical, thermal and physical shock effects.

Other and further objects will be coming evident from the hereinafter set forth drawings and detailed description of the invention.

DETAILED DESCRIPTION OF THE INVENTION

Figure 2:
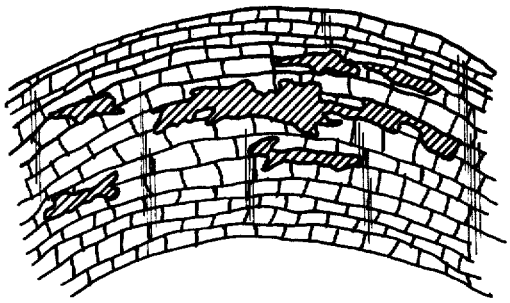
FIG. 2 is a cross-sectional schematic view of a representative region of oil-bearing strata.

It is to be borne in mind that the present petroleum recovery is intended to use existing non-producing or low production wells. Thus, no finding or drilling costs will be involved. In order to stimulate production, it is necessary to provide thermal input, subterranean electrical and physical shock, as well as electro-thermal or chemical charring or coking of the semi-solid hydrocarbon structure in order to increase conductivity, or to reduce its reciprocal, resistivity, in those areas where unrecovered oil may exist. For example, with reference to FIG. 2, one may note the existence of numerous pockets or pools of unrecovered oil. A heavy current flow over a carbonaceous path will, it is believed, also cause heat and steam fracturing or shattering of the sedimentary rock formations, leading to an increase in effective well and reservoir radius. Further, it may cause rock burst (expansion of connate water in heated rocks under stress and/or release of pressure on rocks under stress) by adjacent fracturing thereby providing new paths for the flow of newly freed oil.

Figure 1:
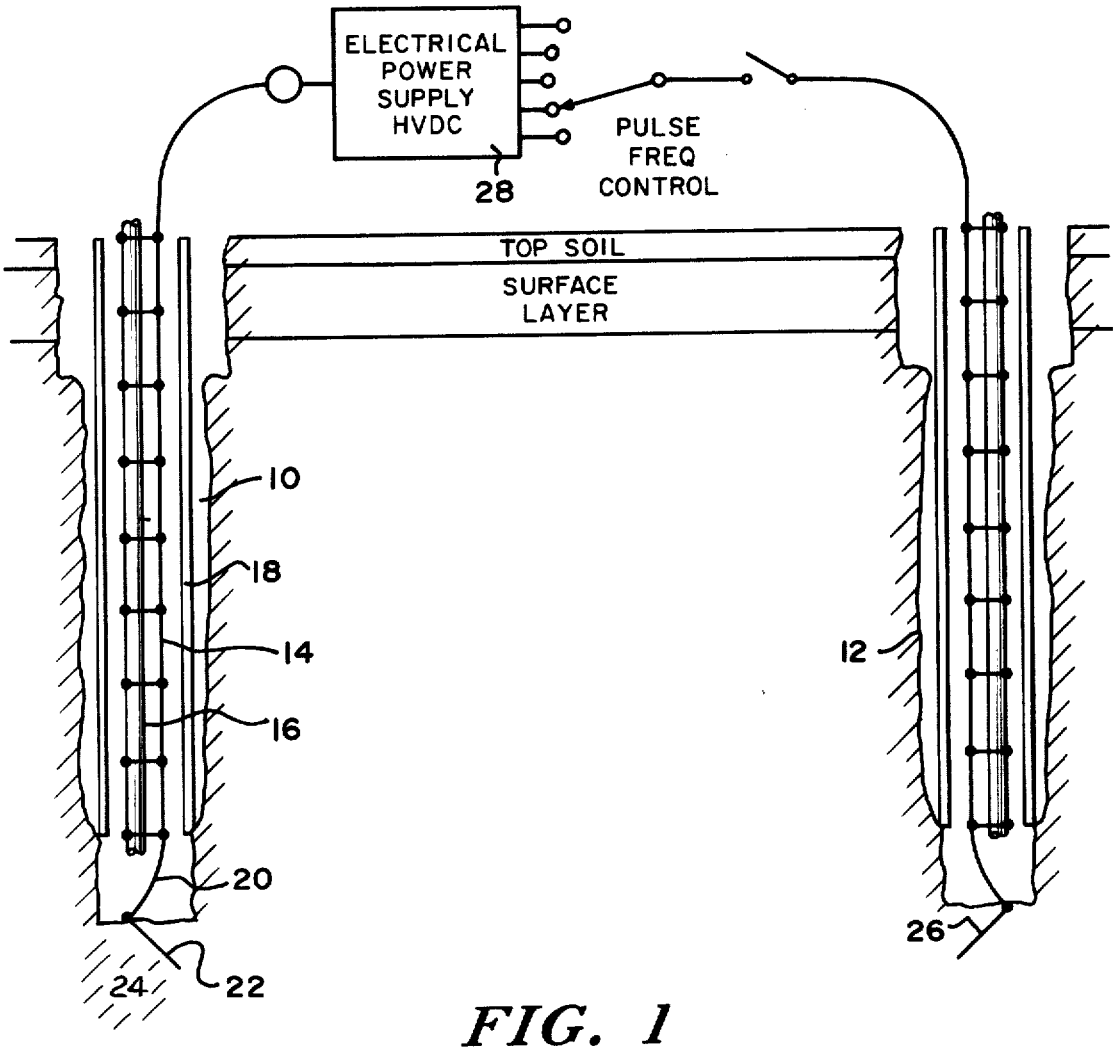
FIG. 1 is a cross-sectional schematic view of an injection and recovery well provided with the method of the present inventive system.

The present process or system of oil recovery requires a minimum of two existing wells: an injection well 10 and a recovery well 12. See FIG. 1. In each well, an insulated high voltage cable 14 is clamped to a steel tubing 16 within the well casing 18, using stand-off insulating clamps in order to support and insulate the cable to the well bottom.

A heavy electrical conductor 20, from inside the insulated cable, is attached to a ground electrode 22 driven several feet down into the fragmented or sedimentary rocks 24 beneath each well. It is noted that, where possible, the electrodes 22 and 26 should be directed toward each other, thereby increasing the probability of completing an electrical circuit between them at their tips. It is noted that the electrodes in each well bottom are insulated from the surface zone and other strata above the lowest sedimentary stratum, and that the well casings are isolated from the conductive surface layer. Thus, the only available electrical path is that between the respective electrodes 22 and 26. This path passes through the resistivity of the sedimentary, or other porous and permeable, rock between the wells. This resistance is, based on available geological data, assumed to be in the order of between ½ ohm and 1000 ohms per meter.

The electrical cables, one from each electrode below the injection and production well, must be kept totally insulated from the surface ground, the steel tubings and the well casings. They are then connected to a variable source of electrical energy 28 (which is hereinafter described in fuller detail). The voltage, current flow and, pulse frequency are adjusted in accordance with the resistance between the two electrodes, which may be as low as 30 ohms or as high as 400,000 ohms, depending on several variables such as the physical and chemical parameters of the oil-bearing stratum, and the distance between electrodes. Typically, said distances will vary between 25 and 3,000 feet.

Initially, bursts or impulses of extremely high voltage may be required to establish a minimal current flow between the electrodes; however, a gradual charring or coking of the semi-solid hydro-carbons between the electrodes will increase conductivity and, therefore, current flow to the point where a heavier current at a lower voltage may be pulsed or sustained while the thermal, electrical and physical shock effects of the electrical energy will (*a*) reduce asphalt or paraffinic clogging, (*b*) reduce the viscosity of the oil otherwise trapped in the stratum, (*c*) fracture certain rock formations within the producing horizon, and between this horizon and adjacent petroleum reservoirs, (*d*) enlarge the area of accessible oil-bearing rock between wells, and (*e*) increase the well radius. Any salt water or moisture in the vicinity of the current flow will be converted to steam and, therefore, will generate steam fracture and pressure drive phenomena.

The underground temperature between electrodes will exceed 500° F., and may approach 1,200° F. It is noted that only 150° to 200° will melt asphalt or paraffin, 550° is required for charring or coking, while higher temperatures may cause "rock burst" as the "conate water" expands and explodes rock formations having little porosity, or the pressure is released on compressed rocks (by opening of adjacent passages by fracturing).

When initial fracturing and heating has been accomplished, a heavier current will be able to flow between electrodes. Accordingly, the input of both the voltage and current may be reduced while still attaining a continuous heating. This may be continued while oil recovery is in progress from the production well, as a pressure drive of the conventional type will be provided at the injection well.

It is to be noted that in the event of a lag in the quantity of recovery, the respective roles of the injection and production wells can be reversed. That is, the output lead of the power supply 28 can be attached to the recovery well, thereby using the former injection well as a recovery well.

As a second embodiment of the present inventive method, it is noted that, under those conditions where the above enumerated desired thermal, electrical and physical shock effects of the electrical energy are not sufficiently forthcoming, the current flow between electrodes 22 and 26 can simply be reversed. Such a current reversal may prove to be more effective with respect to the particular physical and chemical parameters existing within the producing horizon. That is, the phenomenom of electrolysis, galvanic action, or unidirectional flow may occur more readily in the presence of a reverse current flow, depending upon the particulars of the parameters involved.

Turning now to the design requirements of the electrical power supply 28, it is to be understood that, in essence, the present system seeks to simulate the thermal, electrical, and physical shock effect of a lightning bolt delivered at the location of electrode 22. Accordingly, it is necessary to provide an extensive network of capacitative elements having an adequate electrical energy storage capability and, further, being suitably controlled as to discharge parameters including amplitude, frequency, pulse width and energy configuratiion.

Figure 3:
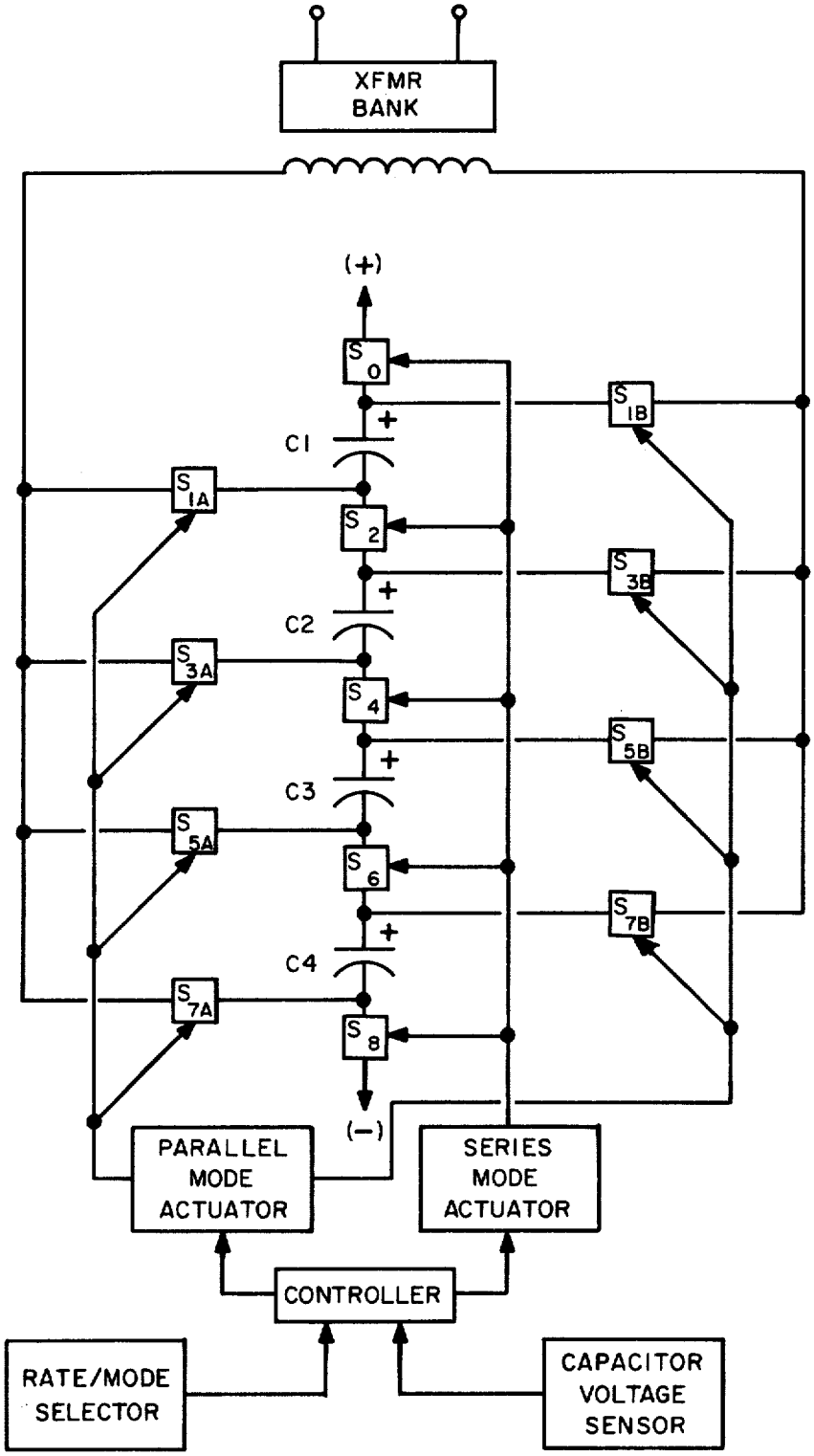
FIG. 3 is a system block diagram of the electrical discharge system.

An overall system block diagram of the present circuit is shown in FIG. 3. The heart of the system consists of a collection of high-voltage, high-energy storage capacitors, labeled C-1, C-2, and C-3 in the figure. Although only three units are shown, it is expected that 12 or more such capacitors will be utilized.

Energy is received from the transformer bank and is stored in the capacitor array. Charging of the capacitors is achieved by connecting them in parallel, by means of electronic switches S-1-A, S-1-B, S-3-A, S-3-B, etc., across the transformer bank secondary. After sufficient charge is stored, the parallel-connecting switches are opened. The amount of charge stored is adjustable and is sensed by the capacitor voltage sensing system. Next the array of charged capacitors is connected in series-aiding across the probe terminals by means of series-connecting electronic switches S-0, S-2, S-4, etc. The system discharges its stored energy into the probe in a short time period, thus giving rise to high power levels. Following the discharge period, the series-connecting switches are opened, and re-charging begins. The control of the electronic switches is carried out by the series-mode and parallel-mode actuators, each receiving commands from the master controller. The length of the discharge period as well as the level of energy storage are to be variable.

Figure 4:
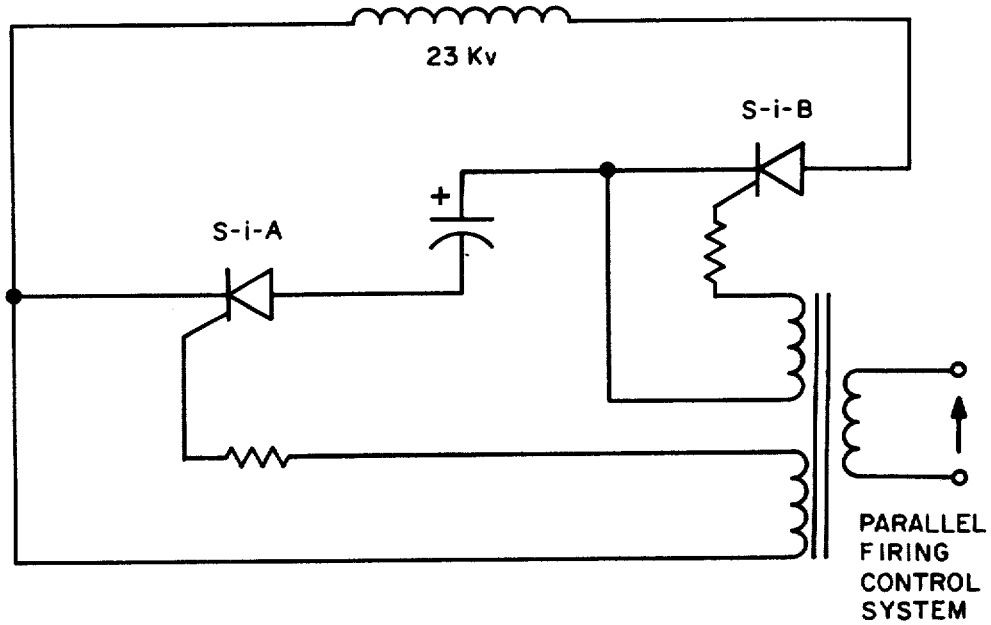
FIG. 4 is a schematic diagram of a parallel charging circuit for use in association with the circuit of FIG. 3.

FIG. 4 shows a typical parallel charging circuit. Upon receipt of a firing control signal, the capacitor is charged from the transformer secondary through S-1-A and S-1-B, The firing control signal is received at the beginning of each cycle in which charging is to take place, and the circuit will commutate naturally.

Figure 5:
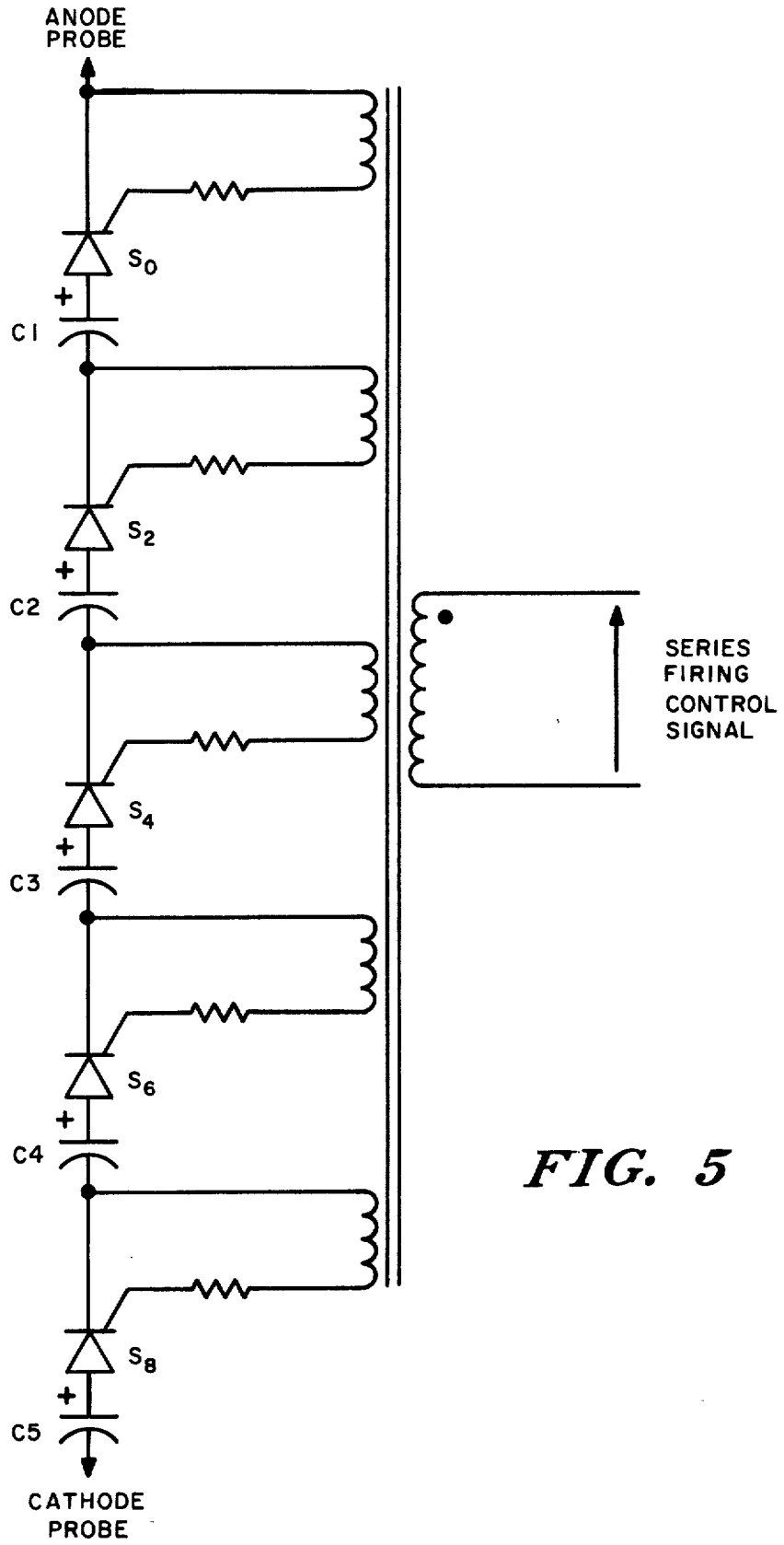
FIG. 5 is a schematic diagram of a series-mode discharge actuator for use in association with the circuit of FIG. 3.

A typical series-mode discharge actuator is shown in FIG. 5. Upon receipt of a series firing control signal, switches S-0, S-2, S-4, etc. will be brought into the circuit, thus connecting the capacitor array in series mode across the probe terminals.

Figure 6:
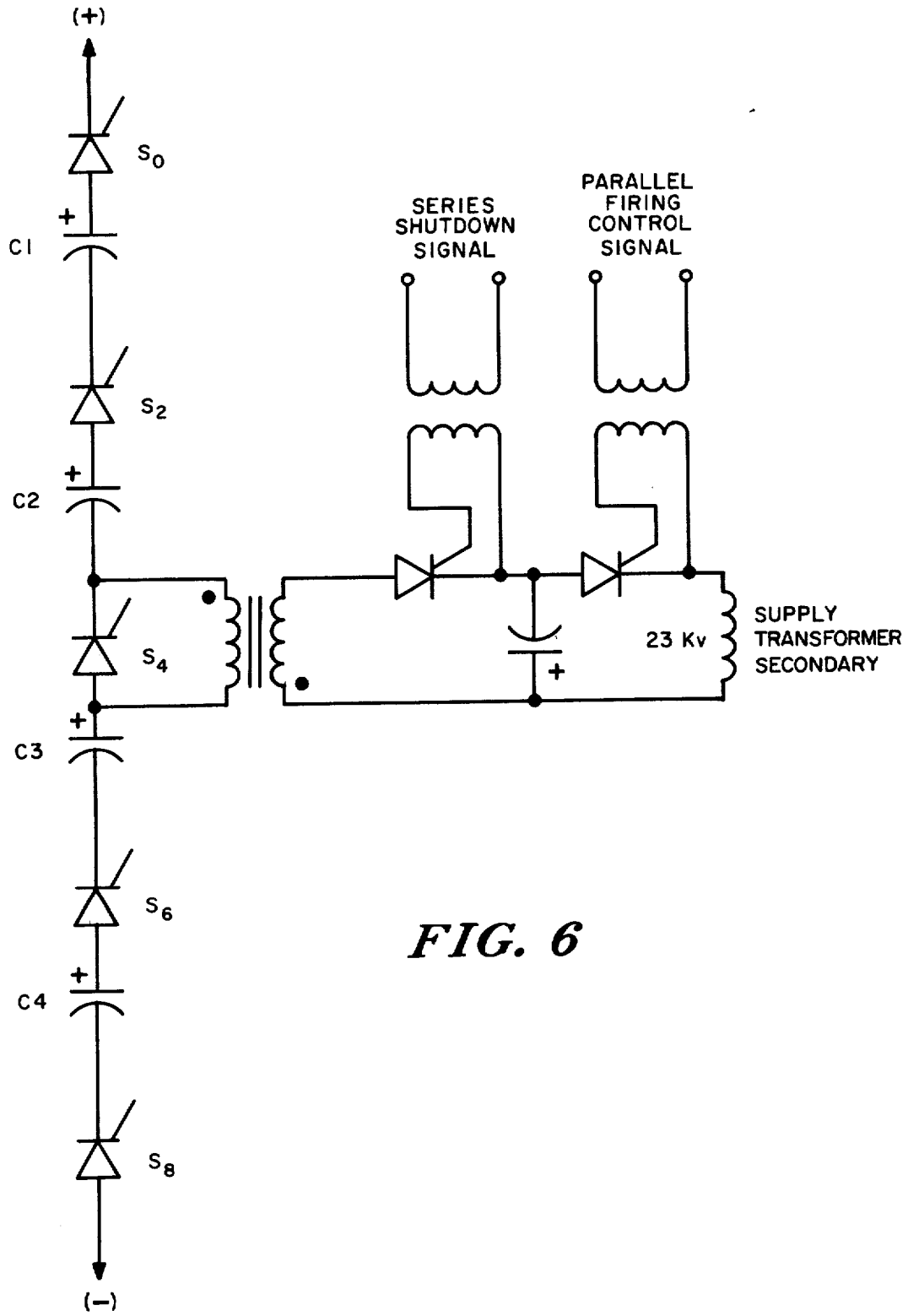
FIG. 6 is a schematic diagram of one embodiment of a shut-down circuit for a series-string of capacitors.
Figure 7:
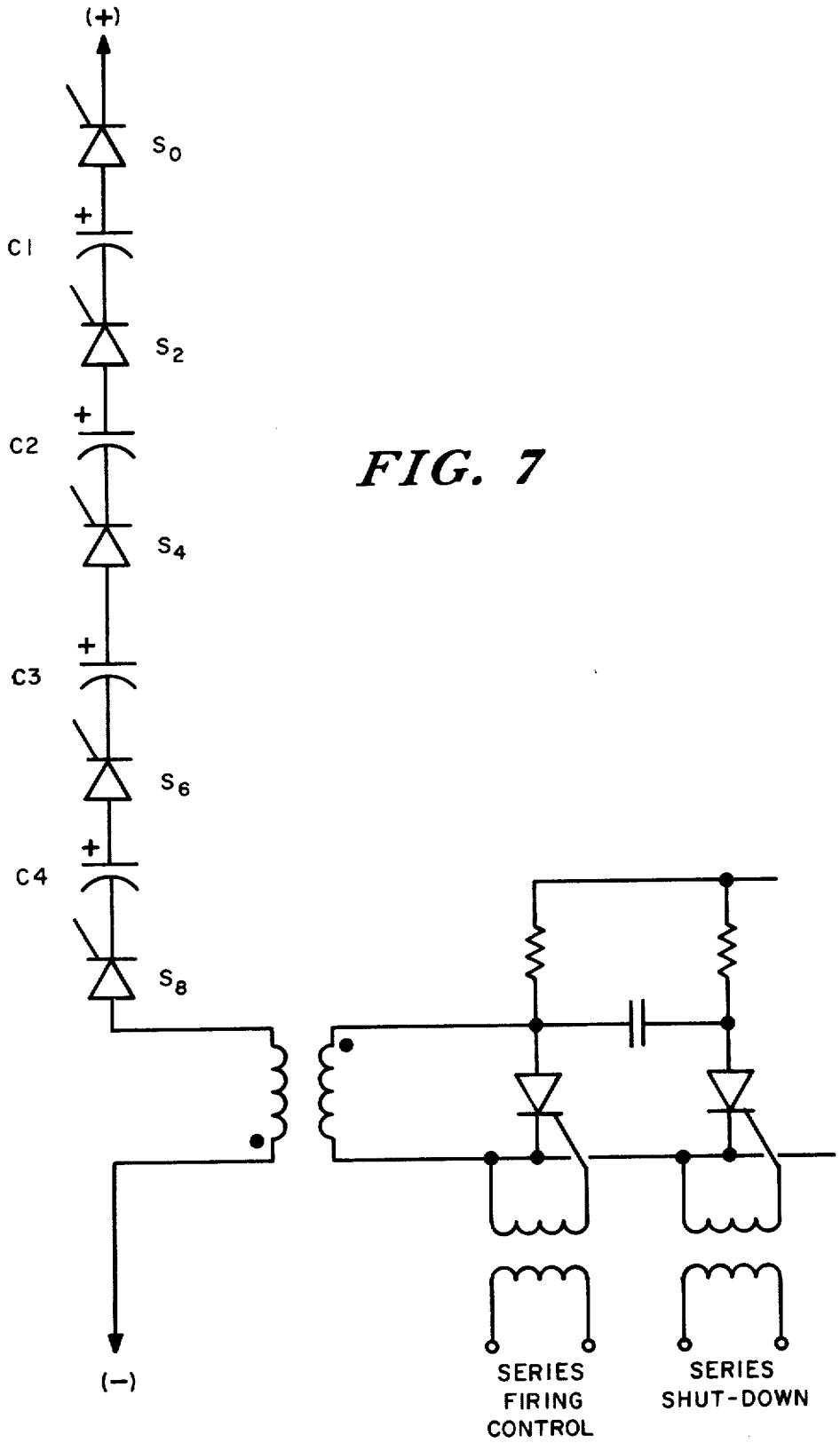
FIG. 7 is a schematic diagram of an alternate embodiment of the circuit in FIG. 6.

At the conclusion of the discharge period, the series string must be shut-down in order to reduce the pulse width of the discharge in order to obtain higher pulse frequencies. Typical shut-down circuits are shown in FIGS. 6 and 7. In FIG. 6, shut-down is accomplished by means of forced capacitor pulse communtation through a coupling transformer. In FIG. 7, shut-down is accomplished by presenting a high transformer impedance in the series string, thus effectively reducing the string current to the point of shut-down.

Figure 8:
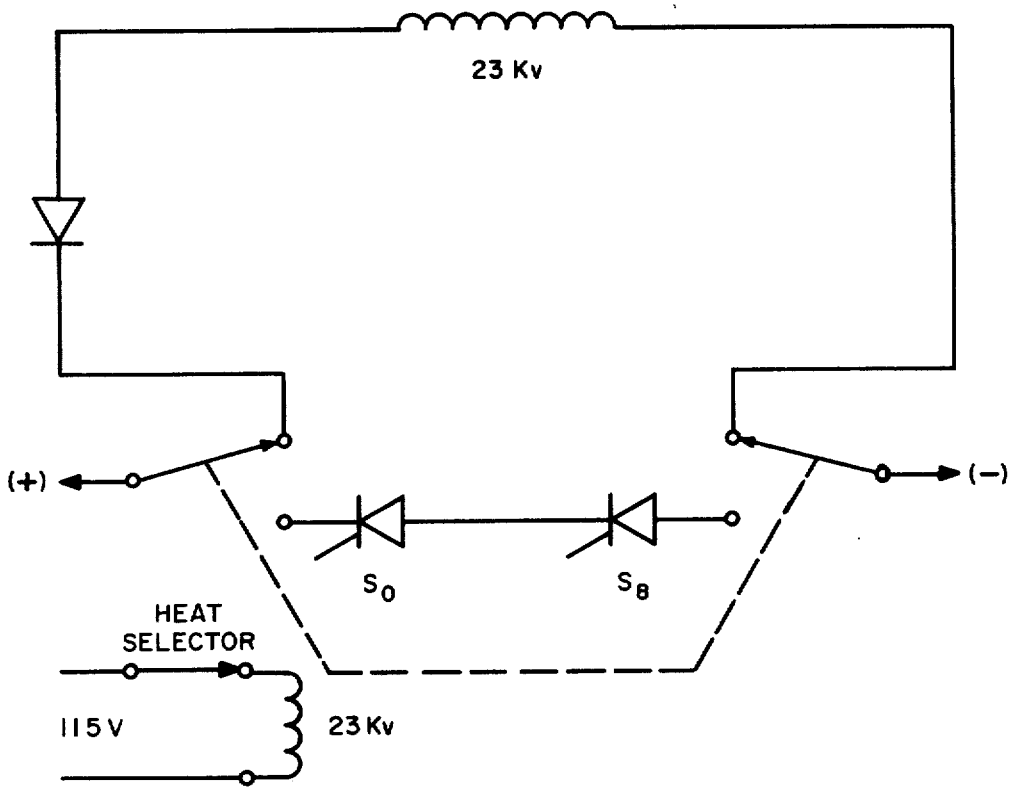
FIG. 8 is a schematic diagram of an auxiliary heating-mode circuit.

An auxiliary heating-mode circuit is shown in FIG. 8. A 23-KV, half-wave rectified voltage is presented to the probe terminals for long-term heating purposes. Connection of the probes to the heating circuit is accomplished by means of a DPDT high-voltage relay circuit.

Figure 9:
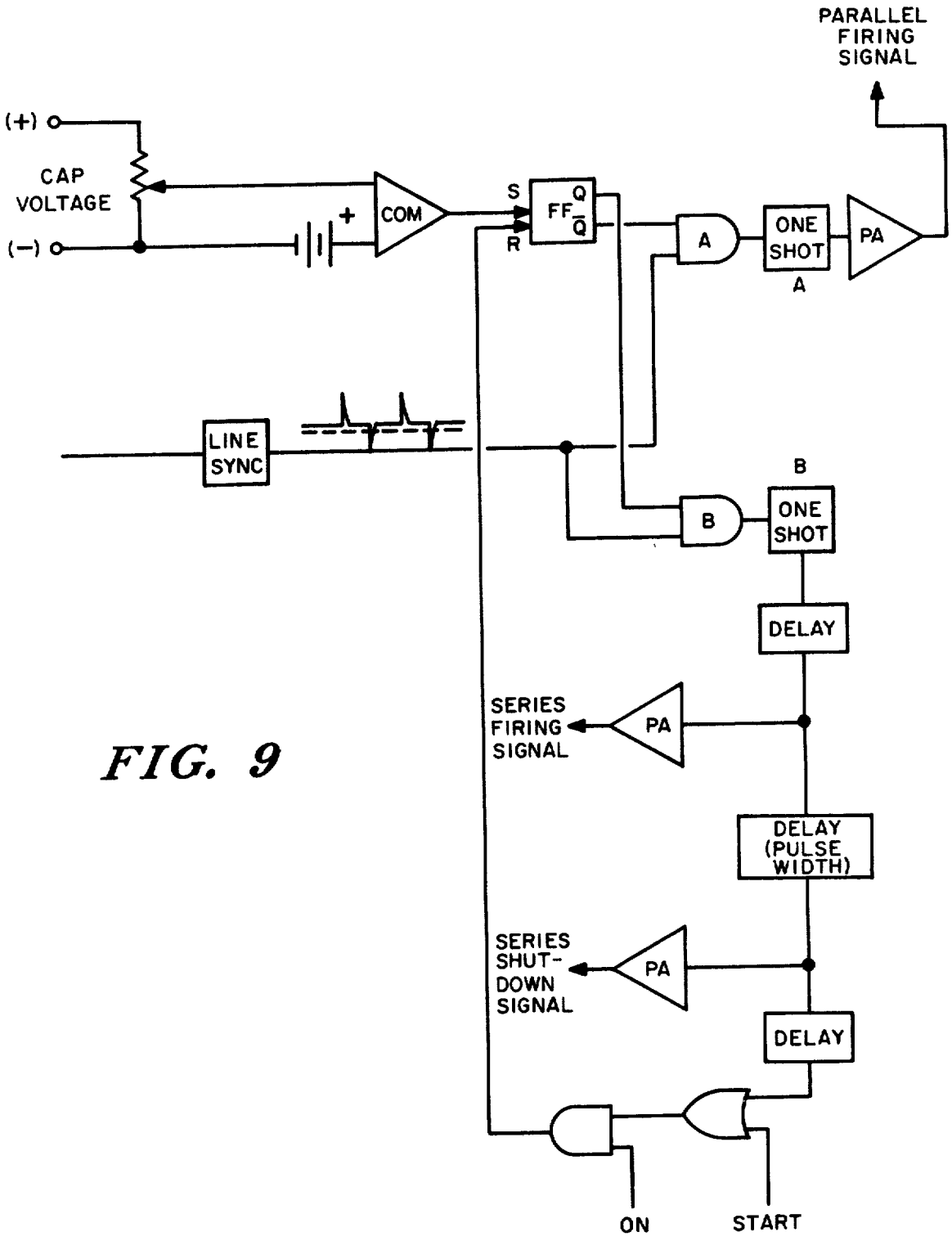
FIG. 9 is a schematic view of a master controller for the circuit of FIG. 3.

The master controller is shown in FIG. 9. Action is initiated by applying the ON signal and a START pulse, which resets the flip-flop. With the flip-flop reset, AND gate "A" is enabled, and AND gate "B" is disabled. Line sync pulses are then used to trigger ONE-SHOT "A." The output of this one-shot is amplified to form the parallel firing signal. This action repeats for as many cycles as may be required to bring the capacitor voltages to the selected level. When the capacitor voltages reach the selected level, the output signal of the COMPARATOR will set the FLIP-FLOP, thus disabling AND gate "A," and enabling AND gate "B." The next line sync pulse will actuate ONE SHOT "B." Its output pulse is delayed and then amplified to become the series-firing signal. After a time period equal to the desired discharge interval has elapsed, the arriving pulse is amplified to become the series shut-down signal. A final delay period elapses and the flip-flop becomes reset again, thus beginning another charge interval.

The illustrated circuitry is capable of a discharge voltage on the order of 253,000 volts DC, a current of about 7,800 amps, and a total energy transfer of about 213 kilowatt-seconds. The minimum charge time is 1.3 seconds, while the mimimum time of discharge is about 1 millisecond.

The rapid discharge of such a high quantity of stored energy will, especially under conditions of low geological resistance, produce an enormous impulse, and electrical and physical shock effect upon the stratum of interest. Further, because of the fact that the above transfer of electrical energy represents the thermal equivalent of about 200 BTU's of heat, a considerable thermal effect will, after several minutes of operation, become noticeable. That is assuming a discharge frequency of thirty times per minute, about 6,000 BTU's will be injected into the geological structure for each minute of operation.

Inasmuch as the geological environment of interest is believed to represent an excellent thermal insulator, and thus as heat localizer, there is every reason to believe that the desired electro-fracturing effect will, after several minutes of operation, become apparent. The present invention represents, it is believed, an advance over the state of the art in that it provides for an advantageous regulation of voltages in excess of 150 kilovolts and, further, provides a control system by which vast quantities of electrical energy can be repetitiously applied in such a manner as to approximate the heating, electrical and physical shock effects of successive bolts of lightning. Also, the present system permits the ready reversal of current flow in those situations where the geological parameters are more receptive to such reverse current.

It is to be appreciated that the physical conditions involved in the present invention may be optimized by the placing of either or both of the probes 22 and 26 near a subterranean deposit of water so as to maximize the possibility of water expansion and thereby of attaining so-called rock burst phenomenon.

Also, said probes may be placed within a stratum of crystalline rock, thereby maximizing the potential for physical fracture of said strata.

Also, the electrodes may be placed in a stratum which is rich in metallic and mineral deposits so as to give rise to inductive effects which may act to enhance the possibility of fracturing through transductive phenomena.

As a further technique, the probes may be directed in a co-linear disposition with respect to each other in order to maximize the uni-directionality of current flow between the electrodes, said step being particularly applicable in geological environments of high metallic and mineral content.

A further advantageous approach comprises the step of frequency-modulating the DC current flow in order to thereby optimize the ionization of mineral molecules within the oil strata, thusly causing an electrolysis to occur and thereby creating an electrolytic condition exhibiting an enhanced current flow, especially within regions of salt water and liquid minerals which occur within oil-bearing strata.

Also, it is to be appreciated that the present method may include the step of applying said electrodes within a sedimentary stratum, thereby, by virtue of the nature of said stratum, giving rise to an electro-osmotic effect in which oil is advanced within said stratum to the cathode electrode or recovery well, while salt water is advanced in the direction of the anode or injection well.

In addition, discharge time of each pulse may be maximized in order to convey a maximum or thermal energy to water and oil deposits, thereby creating a steam or gas expansion which will provide necessary pressure in order to enhance the ease and efficiency of oil recovery. This step will enable each pulse to convey a maximum of thermal energy to deposits of oil, asphalt, and parrafine, thereby reducing the viscosity of said materials, thus enhancing their flow rates and ultimately increasing their ease or recoverability. A further benefit in maximizing the discharge time is to convey a maximum of thermal energy to the oil stratum in order to decrease the electrical resistance thereof, thus increasing the conductivity with a concommitant enchancement of total energy flow, and thus recovery efficiency, within said stratum.

An alternative pulsing method comprises the step of applying spike pulses of the highest attainable amplitude in order to create shock waves within strata of cap rock, thereby enhancing the efficiency of the fracture within said strata in order to therein open paths to new oil reserves.

A still further pulsing method includes the step of continually applying electrical energy at a fixed frequency, established amplitude, and sufficient power in order to give rise to a condition, with the stratum of interest, of a physical resonance, with a concomittant enhancement of sedimentary fracturing.

It is to be appreciated that the input parameters of frequency, amplitude and power may be selectively adjusted in order to attain a condition of physical resonance within the sedimentary stratum.

Further, the present method may include the steps of applying an AC current (including half-wave AC) between said electrodes; and selectively adjusting the input parameters of frequency, amplitude and power in order to attain a condition of physical resonance within the sedimentary stratum.

It is to be noted that the annular cavities of the wells 10 and 12 may, circumferential to the well casing 18, be filled with insulating cement, concrete, epoxy, or any other similar such insulating medium.

With respect to the circuitry, it is noted that the selective actuation of the high energy electrical impulses may be accomplished through the use of a relay or solenoid which, more particularly, may comprise thyratron, ignatron, or SCR which, preferably, would be of a gate turn-off (GTO or GTS) device.

It is thus seen that the object of obtaining an improved method for the supplemental recovery of oil has been efficiently obtained by the above described embodiments of the present invention.

While there have been herein shown and described the preferred embodiments of the present invention, it will be understood that the invention may be embodied otherwise than as herein specifically illustrated or described, and that within said embodiments certain changes in the detail and construction and the form and arrangement of the parts may be made without departing from the underlying ideas or principles of this invention within the scope of the appended claims.

Having thus described my invention what I claim as new, useful and non-obvious and, accordingly, secure by Letters Patent of the United States is a method of production stimulation and enhanced oil recovery from existing oil wells, comprising the steps of:

1. A method of production stimulation and enhanced oil recovery from existing oil wells, comprising the steps of:

(a) disposing an insulated high voltage cable within an injection well and embedding a conductive probe at the end of said cable within an oil-bearing stratum;

(b) disposing an insulating high voltage cable within a recovery well and embedding a probe at the end of said cable within an oil-bearing stratum, said recovery well being between 25 feet and 3,000 feet distance from said injection well;

(c) connecting a high energy charging and discharge circuit, at the surface level, between each of said cables associated with said injection and recovery wells;

(d) applying a voltage, current, frequency and pulse width control circuit to said charging and discharge circuit; and (e) selectively actuating the above circuitry in order to produce sequential high energy electrical impulses originating at the electrode embedded within the injection well, thereby producing electrical, thermal, physical and sonic shock effects sufficient to produce geological fracturing and, thereby, oil flow between said electrodes.

2. The method as recited in claim 1 in which said method further comprises reversing the direction of current flow in order to secure advantageous results in those situations where the physical and chemical parameters of the oil-bearing stratum are more receptive to such a reverse current.

3. The method as recited in claim 1 in which said method further comprises the step of actuating the discharge of electrical energy in such a manner as to maximize the transfer of thermal energy to the sedimentary stratum thereby enhancing the possibility of a coking or charring effect within said stratum.

4. The method as recited in claim 1 in which said method further comprises the step of repetitiously discharging a maximum amount of electrical energy during the smallest possible time frame, thereby maximizing the shock wave effect and, thus, the fracturing experienced by the sedimentary stratum.

5. The method as recited in claim 1 in which said method further comprises the step of placing either or both of said probes near a subterranean deposit of water so as to maximize the possibility of water expansion and thereby of attaining so-called rock burst phenomenon.

6. The method as recited in claim 1 in which the present method further comprises the step of placing said electrode probes within the strata of crystalline rock, thereby maximizing the potential for physical fracture of said strata.

7. The method as recited in claim 1 in which said method further comprises the step of applying said electrodes in a stratum which is rich in metallic and mineral deposits so as to give rise to inductive effects which may act to enhance the possibility of fracturing through transductive phenomena.

8. The method as recited in claim 1 in which said method further comprises the steps of directing said probes in a co-linear disposition with respect to each other in order to maximize the uni-directionality of current flow between the electrodes, said step being particularly applicable in geological environments of high metallic and mineral content.

9. The method as recited in claim 1 in which said method further comprises the step of frequency-modulating the DC current flow in order to thereby optimize the ionization of mineral molecules within the oil stratum, thusly causing an electrolysis to occur and thereby creating an electrolytic condition exhibiting an enhanced current flow, especially within regions of salt water and liquid minerals which occur within oil-bearing strata.

10. The method as recited in claim 1 in which said method further comprises the step of applying said electrodes within a sedimentary stratum, thereby, by virtue of the nature of said stratum, giving rise to an electro-osmotic effect in which oil is advanced within said stratum to the cathode electrode or recovery well, while salt water is advanced in the direction of the anode or injection well.

11. The method as recited in claim 1 in which said method further comprises the step of maximizing the discharge time of each pulse in order to convey a maximum of thermal energy to water and oil deposits, thereby creating a steam or gas expansion which will provide necessary pressure in order to enhance the ease and efficiency of oil recovery.

12. The method as recited in claim 1 in which said method further comprises the step of maximizing the discharge time within each pulse in order to convey a maximum of thermal energy to deposits of oil, asphalt, and paraffine, thereby reducing the viscosity of said materials, thus enhancing their flow rates and ultimately increasing their ease of recoverability.

13. The method as recited in claim 1 in which said method further comprises the step of maximizing the discharge time in order to convey a maximum of thermal energy to the oil stratum in order to decrease the electrical resistance thereof, thus increasing the conductivity with a concomitant enhancement of total energy flow, and thus recovery efficiency, within said stratum.

14. The method as recited in claim 1 in which said method further comprises the step of applying spike pulses of the highest attainable amplitude in order to create shock waves within strata of cap rock, thereby enhancing the efficiency of the fracture within said strata in order to therein open paths to new oil reserves.

15. The method as recited in claim 1 in which said method further comprises the step of continually applying electrical energy at a fixed frequency, established amplitude, and sufficient power in order to give rise to a condition, with the stratum of interest, of a physical resonance, with a concomittant enhancement of sedimentary fracturing.

16. The method as recited in claim 15 in which said method further comprises the step of selectively adjusting the input parameters of frequency, amplitude and power in order to attain a condition of physical resonance within the sedimentary stratum.

17. The method as recited in claim 1 in which said method further comprises steps of:

(i) applying an AC current between said electrodes; and (ii) selectively adjusting the input parameters of frequency, amplitude and power in order to attain a condition of physical resonance within the sedimentary stratum.

18. The method as recited in claim 1 in which said method further comprises the step of forming an annular cylindrical cavity about the surface region of both said injection well and said recovery well in order to remove the conductive surface layer from the vicinity of the casing and to thereby reduce the liklihood of high voltage flashover to ground potential from the current conductors.

19. The method as recited in claim 18 in which said method further comprises the step of filling each of said annular cavities with an epoxy or similar such insulating medium.

20. The method as recited in claim 18 in which said method further comprises the step of filling each of said annular cavities with an insulating cement or concrete.

21. The method as recited in claim 1 in which said method further comprises the step of continually applying a reversible, fixed pulse rate DC current to the electrodes.

22. The method as recited in claim 21 in which said method further comprising the step of applying a half-wave current.

23. The method as recited in claim 1 in which said step (e) of selective actuation includes the step of utilizing mechanical switches.

24. The method as recited in claim 1 in which said step (e) of selective actuation includes the step of using a relay or solenoid.

25. The method as recited in claim 1 in which said step (e) of selective actuation comprises the step of using a thyratron.

26. The method as recited in claim 1 in which said step (e) of selective actuation comprises the step of using an ignatron.

27. The method as recited in claim 1 in which said step (e) of selective actuation comprises the step of using an SCR.

28. The method as recited in claim 1 in which said step (e) of selective actuation comprises the step of using a gate turn-off (GTO or GTS) solid state device.

* * * * *